United States Patent [19]

Storey et al.

[11] Patent Number: 4,967,509

[45] Date of Patent: Nov. 6, 1990

[54] SECURITY WINDOW SHUTTER

[76] Inventors: Leonard M. Storey, 21820-235 Marylee St., Woodland Hills, Calif. 91367; Glen M. Storey, 381 Countryside Rd., Agoura, Calif. 91301

[21] Appl. No.: 461,380

[22] Filed: Jan. 5, 1990

[51] Int. Cl.[5] ..... E05F 17/00

[52] U.S. Cl. ..... 49/74; 49/56; 49/64; 49/75

[58] Field of Search ..... 49/74, 64, 50, 51, 75, 49/56, 54, 67, 76; 52/106, 473; 160/236

[56] References Cited

U.S. PATENT DOCUMENTS

| | | | |
|---|---|---|---|
| 100,593 | 3/1870 | Brock | 52/473 |
| 504,533 | 9/1893 | Lunken | 49/75 |
| 2,651,085 | 9/1953 | Kopp | 52/473 X |
| 3,113,355 | 12/1963 | Tracy et al. | 49/50 |
| 3,378,955 | 4/1968 | Wahlgren | 49/56 X |
| 4,160,343 | 7/1979 | Hubbard | 49/90 |
| 4,436,136 | 3/1984 | Downey, Jr. | 160/236 X |
| 4,452,010 | 6/1984 | Whittington et al. | 49/51 |
| 4,485,589 | 12/1984 | Rodriguez-Torres | 49/50 X |
| 4,485,841 | 12/1984 | Hixenbaugh | 49/74 X |
| 4,505,069 | 3/1985 | Freeman | 49/64 |
| 4,638,596 | 1/1987 | Gallardo | 49/56 |
| 4,688,351 | 8/1987 | Torres | 49/74 |
| 4,694,608 | 9/1987 | Lambert | 49/64 X |
| 4,724,634 | 2/1988 | Blum | 49/51 |

FOREIGN PATENT DOCUMENTS

| | | | |
|---|---|---|---|
| 2316419 | 1/1977 | France | 49/54 |

*Primary Examiner*—Philip C. Kannan

*Attorney, Agent, or Firm*—Christie, Parker & Hale

[57] ABSTRACT

A high security grating which resembles a conventional wooden window shutter. The shutter uses crossbars which extend across a door or window into a shutter frame. A tie rod extends through bores in the crossbar ends to tie the crossbars together and hold them in place. A metal frame covers the tie rods and shutter blades cover the crossbars. The shutter blades can be pivoted using an operator rod. The shutters are mounted inside a building using heavy duty hinges and deadbolts which allow them to be alternatively closed over a door or window or folded away to the side.

42 Claims, 3 Drawing Sheets

SECURITY WINDOW SHUTTER

FIELD OF THE INVENTION

The present invention relates to the field of security devices for structures and, in particular, to a decorative shutter for windows or doors which blocks ingress and egress.

BACKGROUND OF THE INVENTION

Window and door shutters for buildings can be mounted either on the inside or the outside of a building to cover a window or door opening. They block light and intruding eyes, and, when mounted on the outside, they protect the openings from external elements. Conventional well known shutters are typically made of wood and thought to be an attractive addition to houses and commercial buildings. Conventional shutters, however offer no security to the occupants inside the building. They can normally be opened easily from the outside, and, even if well locked, they can be easily bent, broken or torn away from the opening to allow an intruder to enter the building.

In order to increase security, a variety of protective gratings and grilles have been developed for windows and doors. The most common type is a steel cage bolted to the outside of a building. The cage bars are close enough together to keep potential intruders out. Security grilles are often thought to be unattractive and are typically made to resemble Mediterranean wrought iron art work. When bolted to the outside of a structure, they also prevent any building occupants from leaving through the window or door which is protectively grated during an emergency. U.S. Pat. No. 4,638,596 to Gallardo shows a security window grating which is mounted to the inside of a building so that it can be opened in an emergency. U.S. Pat. No. 4,485,589 to Rodriguez-Torres and U.S. Pat. No. 4,452,010 to Whittington et al show security window gratings which combine some of the functional features of conventional window shutters with an exterior mounted security window grating. The system in Whittington et al can be opened from the inside. Neither system offers as much security as a conventional grating, nor the functionality, attractiveness and convenience of a conventional wooden window shutter.

SUMMARY OF THE INVENTION

The present invention is as convenient to use and attractive as a conventional wooden window shutter, but offers as much or better security than a conventional window grating. It includes a series of slats which can be adjusted to select how much light is allowed to pass through without compromising security, and it can be easily folded out of the way when security is not important.

In one embodiment, the invention is a shutter for adjustably blocking an opening with a plurality of elongated crossbars extending across the opening, where the end of each crossbar has a transverse bore. A tie rod assembly extends through the bores in the crossbars to prevent the crossbars from being pulled into the opening, and slats are mounted to the crossbars so that they may be pivoted to adjust the degree to which the opening is blocked. The slats pivot with respect to the crossbars if the crossbars are fixed. The shutter preferably also includes a frame adjacent the periphery of the opening, which encloses the crossbar ends and tie rod assembly. The frame is hinged with respect to the opening so that it can be folded against or away from the opening for security. When folded against the opening, the shutter may be fastened in place to securely block the opening.

In another embodiment, the shutter, which is adapted for application to an opening, has a frame which defines an inner space and a plurality of crossbars which extend across the inner space. The ends of the crossbars extend into the frame. A tie rod assembly within the frame connects to the ends of the crossbars to prevent the crossbar ends from being pulled out of the frame, and a plurality of slats are connected to the crossbars so that the slats may be pivoted to vary the degree to which the space is blocked. Preferably, the frame houses an inner wall with a plurality of holes through which the crossbar ends extend. The tie rod assembly extends along the side of the inner wall which is opposite the space defined by the frame. It extends adjacent the portion of the inner wall which is between the holes substantially perpendicular to the crossbars, this prevents the tie rod assembly from being pulled through the holes in the inner wall.

The crossbars preferably have a transverse bore at their ends within the frames, through which the tie rod assembly extends. The crossbars may be substantially straight and parallel so that there is a first set of crossbar ends and a second set of crossbar ends opposite the first set. One tie rod is connected to the first set of crossbar ends, and a second tie rod is connected to the second set of crossbar ends. The crossbars are preferably made primarily of steel or steel cable as is the tie rod assembly. The slats may be filled with thermal insulation so that the shutter not only protects against prying eyes and intruders, but also against temperature.

DETAILED DESCRIPTION OF THE INVENTION

Figure 1:
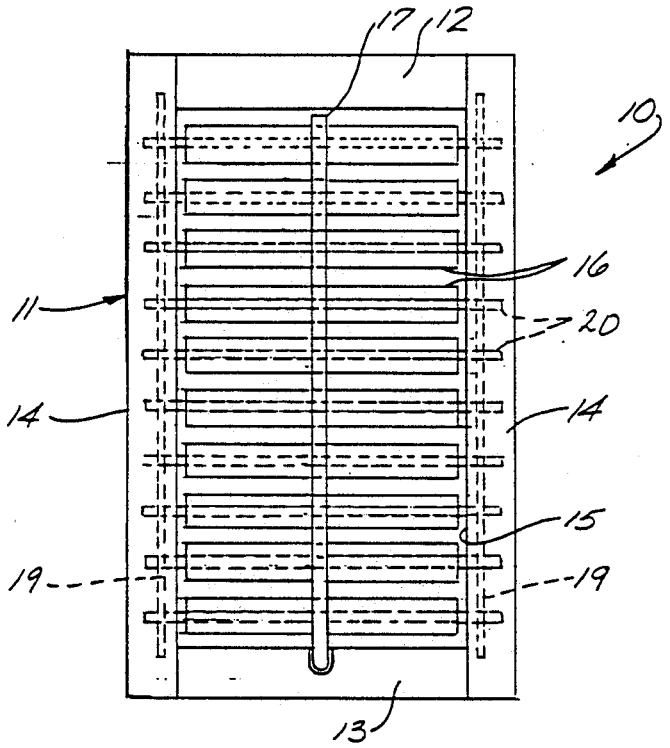
FIG. 1 is a front elevation view of a shutter according to the invention.

FIG. 1 shows a front elevational view of the window shutter system of the present invention. The window shutter 10 is designed to resemble a conventional interior or exterior wooden window or door shutter in appearance as much as possible. This allows the shutter to be used without aesthetic objections wherever conventional shutters can be used. However, because the internal construction of the window shutter 10 is very different from that of a conventional window shutter, the degree of security offered is also much greater.

The shutter 10 has a metal frame 11 preferably made of a top hollow tubular steel member 12 and a bottom hollow tubular steel frame member 13. These are joined to hollow tubular side frame members 14 at either side. The frame members may be cylindrical, rectangular, elliptical or any other elongated shape. While the frame is preferably constructed of metal, other high-strength materials may be used, for example, some high-strength plastics. The stronger the material used, the greater the security afforded by the invention. The horizontal frame members may have a mitered connection to the side frame members as shown in FIG. 1, or the sections may be butted or otherwise connected together.

For a conventional rectangular window, the frame members form a conventional rectangular frame which surrounds a smaller rectangular opening 15 in the frame. While the embodiment shown here is for a rectangular window or door, the invention can easily be adapted to fit other shaped openings by varying the shapes and dimensions of the parts. Round, triangular and other window and door shapes can be accommodated.

Figure 2:
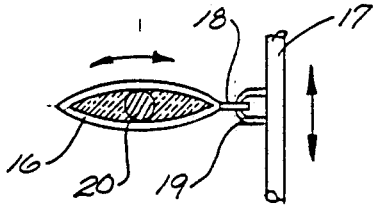
FIG. 2 is a cross-sectional view of a slat and crossbar according to the present invention, connected to an operating, lead.

A series of horizontal shutter blades or slats 16 extend parallel to each other across the opening 15 at vertical intervals in the frame opening. The shutter blades are coupled at their middles to a vertical operator lead 17 located on the interior side of the shutter. As shown in FIG. 2, eaoh shutter blade has a hook lB whioh connects to a loop 19 on the operator lead. By moving the operator lead up and down, the slats are pivoted to open or close the shutter to light, as is well known in conventional shutters. As shown in FIG. 2, each shutter blade is preferably hollow and made of sheet metal or some similar material. However, solid or hollow wood or fabric may be used to give the shutter a softer appearance and texture. Because the slats are not a part of the secure framework of the invention, they may be made of any material desired. The slats may also be vertical or diagonal rather than horizontal as shown in the drawings.

A steel support axle or crossbar 20 extends through the center of each shutter blade, supporting the shutter blades in the frame opening !5. The crossbars are preferably made of steel because they perform the most important security function of the invention, although other high strength metals or plastics may be used. The steel should be thick enough so that the crossbars cannot easily be bent by hand or common tools which might be used by a burglar. As shown in FIG. 1, the crossbars extend across the opening in the center of the frame into both of the side frame members 14.

As explained below, the crossbar members preferably do not themselves rotate. Therefore, to achieve the pivoting action shown by the arrows in FIG. 2, the hollow slats 16 must be allowed to pivot with respect to the respective crossbars 20. This can be done simply by providing a loose connection between the slat and the crossbar, or by providing any of a variety of sleeved or journaled mountings. To reduce friction, the crossbar 20 could be coated with a long-lasting lubricant, for example, polytetrafluoroethylene resin.

Figure 3:
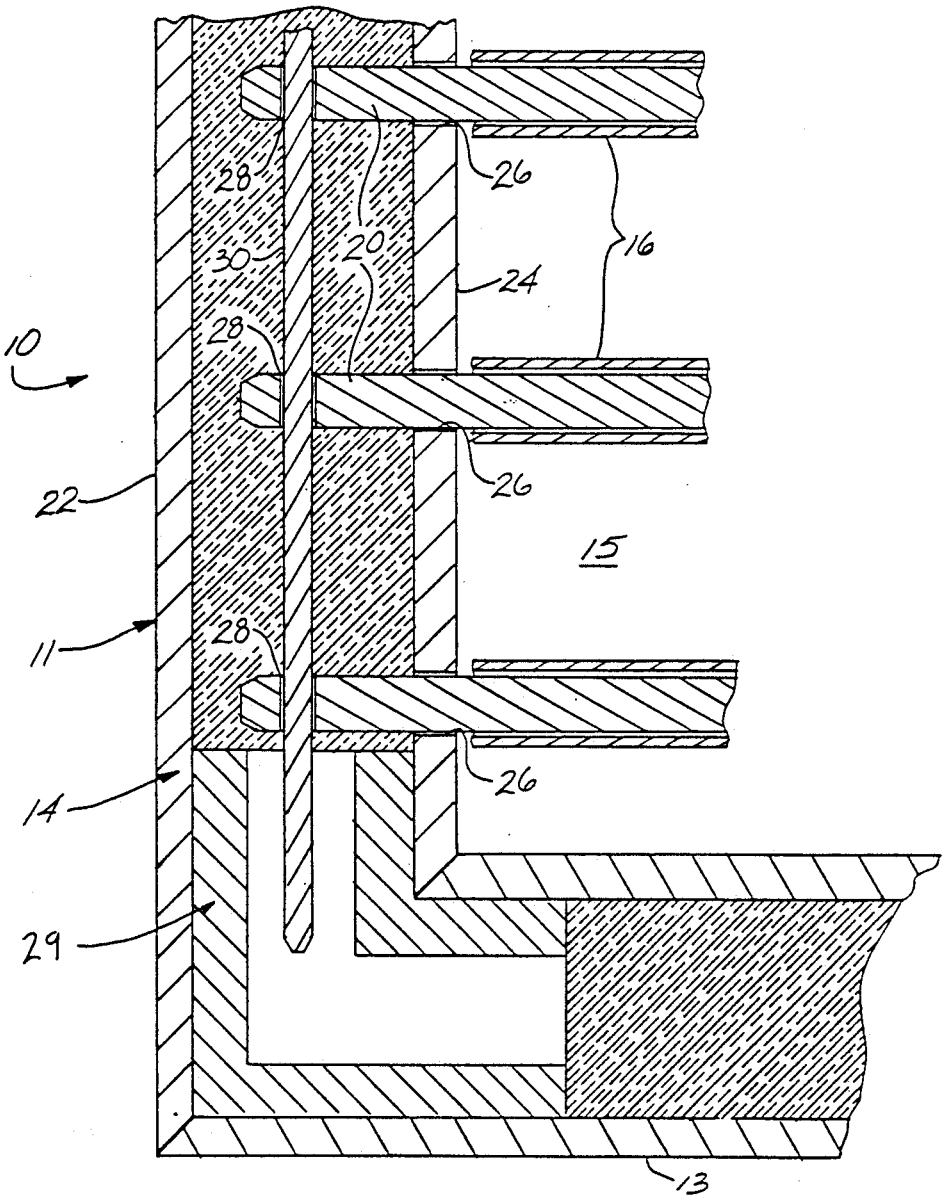
FIG. 3 is a cross-sectional view of a corner of the frame of the shutter of FIG. 1.

FIG. 3 shows how the crossbars 20 preferably are fastened to the inside of the side frame members 14. The side frame members are hollow and have, accordingly, an outer wall 22 and an inner wall 24. The inner wall has a set of preferably regularly spaced holes 26 through which the crossbars 20 extend. The ends of the crossbars are then within the side frame members 14. A diametric or transverse bore 28 is drilled all the way through each crossbar near the end of each side frame member. These transverse bores are aligned within the hollow of the frame, so that a single tie rod 30 can pass through all of the transverse bores extending into one side frame member.

The tie rod 30 limits the horizontal motion of the crossbars. The slats 16 extend essentially from one end of the opening to the other end of the opening and effectively limit the motion of the crossbars in normal use. However, the slats do not need to be strong enough to resist all attempts at intrusion. If a potential intruder pulls on a crossbar to draw the crossbar out of the frame and thereby gain entrance to the building, the crossbar 20 necessarily draws the tie rod 30 toward the inner side frame wall 24. This requires that the tie rod be bent or that all the crossbars be bent. As shown in FIG. 3, the tie rod is substantially parallel to the inner side frame wall and is held in place by the bores in each of the crossbars. Accordingly, it is virtually impossible to pull the tie rod through any of the holes 26. The tie rod can only be removed by withdrawing it vertically from the row of aligned bores in each of the crossbars. This requires first opening the frame 13. The crossbars can only be removed by removing the tie rod or by removing the walls of the side frame members. Accordingly, it is important that the metal frame walls be made strong enough to resist intruders.

FIG. 3 also shows a corner fitting made of material similar to that of the frame members preferably used for connecting the frame members together at the corners of the frame. The corner fitting 29 simplifies and strengthens the mitered connection between the frame members at their ends. The frame members may be bolted, welded, or in some other way fastened to the fitting or fastened only to each other.

The present invention's high-strength steel security grating is shrouded by the frame 11 and the shutter blades 16 which make it look more like a conventional wooden shutter. As the frame is assembled, the high-strength grating can easily be assembled within it simply by sliding the crossbars into place and then sliding the tie rods through the aligned bores in the crossbars. A different method for securing the crossbars in position than that shown in the figures could be used. It is important that the crossbars not be allowed to move significantly laterally, but it may be desired to provide a mounting arrangement which allows the crossbars themselves to pivot. Then when the operator lead 17 is pulled up and down, both the crossbars and the shutter blades 16 would pivot together.

The frame and shutter blades render the high-strength steel security grating much more aesthetically pleasing and add additional functionality. The shutters can be moved through the operator lead just as those of a conventional wooden shutter can be. The appearance of the shutter can be enhanced by painting the frame and shutter blades to resemble wood or some other ornamental material, or by covering the shutter blades and frame with a wood veneer. As mentioned above, the shutter blades can be constructed of wood or some other aesthetically pleasing material, provided that the crossbars are allowed to retain their strength. The utility of the shutter can be further enhanced by filling all the hollow spaces, both within the frame and within the individual shutter blades, with an insulating material. The shutters would be closed then not only for privacy, but also to help keep heat inside or outside the structure.

Figure 4:
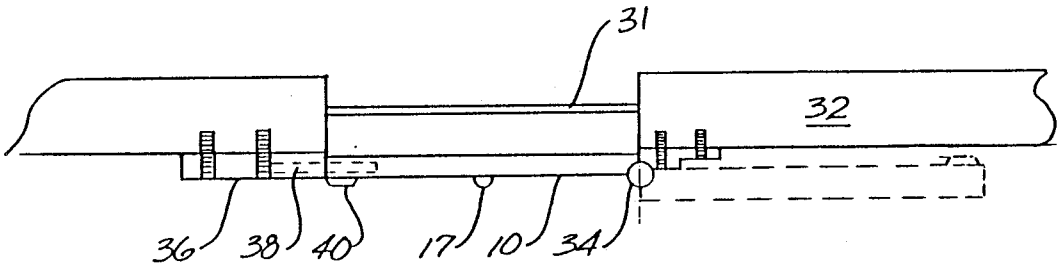
FIG. 4 is, a top plan view of a shutter mounted to a window frame according to the present invention.

It is preferred that the shutters be mounted on the inside of the window or door, although this is not required. This allows them to be easily opened and adjusted. FIG. 4 shows a typical application to a conventional single-pane window 31. The security shutter 10 is mounted to a building wall 32 using a hinge 34. The portion of the wall to which the hinge is mounted may be a window or door frame, or it may be a shutter mounting frame or the wall itself, depending on the application. The hinge should be strong enough to resist intruders, yet aesthetically pleasing. At the opposite sides of the window, the shutter 10 is latched into a latching block 36 using an extended deadbolt 38. The deadbolt is concealed within the frame of the shutter, as by being mounted in the top or bottom frame members or in each of them, so that only the handle mechanism 40 can be seen from outside the shutter. While a deadbolt is presently preferred, other types of latches can also be used. In this position, the shutter blades can be easily operated using the operator lead 17. The security shutter can be folded away from the window simply by withdrawing the deadbolt latch 38 and pivoting the security shutter on its hinge 34 to the position shown in dotted lines. The window then allows the full amount of sun light to stream in or could be used for entry and exit. The same mounting arrangement can also be easily applied to doorways.

Figure 5:
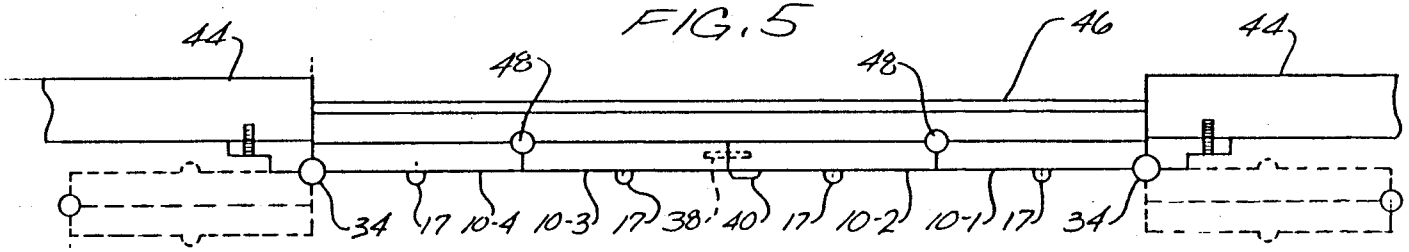
FIG. 5 is a top plan view of a set of shutters mounted to a window frame according to the present invention.

FIG. 5 shows a more complex mounting system for a group of shutters constructed according to the present invention. In FIG. 5, a series of four security shutters 10-1 to 10-4 are mounted to the building walls 44 on either side of a wide window 46. The outermost shutters 10-1 and 10-4 are mounted to the walls 44 with heavy-duty hinges 34. The inner shutters 10-2 and 10-3 are mounted to the outer shutters 10-1 and 10-4, with further heavy duty inner hinges 48. Since these hinges are exposed to any intruders, it is important that they be built with security in mind. A variety of high-security hinges known in the art can be used. The inner shutters 10-2 and 10-3 are latched into each other using a long deadbolt latch 38 controlled by handle 40, as in FIG. 4. The shutters can be latched and folded against the walls 44 into the position shown in dashed lines, as is commonly done with conventional wooden shutters. The security arrangement of FIG. 5 can be further enhanced by providing additional deadbolt latches which connect in&:o the walls above and below the windows.

While only a few embodiments have been disclosed, the present invention is not limited to the embodiments described in the present specification. A large number of modifications and adaptations can be made to accommodate different window settings and different types of buildings, as well as different security needs. It is not intended to limit the scope of the following claims in any way by the disclosure.

What is claimed is:

1. A shutter for adjustably blocking an opening comprising:

a plurality of elongated crossbars extending across the opening, the end of each crossbar having a transverse bore;

a tie rod assembly extending through the bores in the crossbars to prevent the crossbars from being pulled into the opening; and a plurality of slats mounted to the crossbars so that they may be pivoted to adjust the degree to which they block the opening.

2. The shutter of claim 1 wherein the slats pivot with respect to the crossbars, and the crossbars are fixed.

3. The shutter of claim 1 wherein the shutter comprises a frame adjacent the opening's periphery, and wherein the crossbar ends and tie rod assembly are within the frame.

4. The shutter of claim 3 wherein the frame is hinged with respect to the opening.

5. A shutter for application to an opening comprising:

a frame defining an open central space;

a plurality of crossbars extending across the space with their ends extending into the frame, the ends each having a bore within the frame; and a tie rod assembly within the frame extending through the bores in the ends of the crossbars to prevent the crossbar ends from being pulled out of the frame.

6. The shutter of claim 5 wherein the frame comprises an inner wall, the wall having a plurality of holes through which the crossbar ends extend.

7. The shutter of claim 6 wherein the tie rod assembly extends along the side of the inner wall opposite the space defined by the frame.

8. The shutter of claim 7 wherein the tie rod assembly extends adjacent to the portion of the inner wall between the holes and substantially perpendicular to the crossbars to prevent the tie rod assembly from being pulled through the holes in the inner wall.

9. The shutter of claim 5 wherein the crossbars are substantially straight and parallel, there being a first set of crossbar ends and second opposite set of crossbar ends, and wherein the tie rod assembly comprises a first tie rod extending through the first set of crossbar ends and a second tie rod extending through the second set of crossbar ends.

10. The shutter of claim 5 wherein the tie rod assembly comprises tie rods which are substantially perpendicular to the crossbars.

11. The shutter of claim 10 wherein the frame comprises an inner wall, the crossbar bores and tie rod assembly being on the side of the wall opposite the central space, and wherein the crossbars extend through holes in the inner wall into the central space.

12. The shutter of claim 5 wherein the crossbars are made primarily of steel.

13. The shutter of claim 5 wherein the tie rod assembly is made primarily of steel.

14. The shutter of claim 5 wherein the frame is hollow.

15. The shutter of claim 14 wherein the frame comprises joined hollow steel tube sections.

16. The shutter of claim 5 wherein the frame is adapted to be applied to a window.

17. The shutter of claim 16 comprising hinges for pivotally connecting the frame to a building wall.

18. The shutter of claim 17 comprising a latch for holding the frame against the building wall.

19. The shutter of claim 18 wherein the frame is hollow, and the latch is substantially inside the frame.

20. The shutter of claim 16 wherein the window separates the interior and exterior of a building, and wherein the shutter is adapted to be mounted adjacent the interior side of the window.

21. The shutter of claim 5 comprising a plurality of slats connected to the crossbars so that they may be privoted to vary the degree to which the space is blocked.

22. The shutter of claim 21 wherein the slats comprise thermal insulation.

23. The shutter of claim 21 wherein the slats are connected by an operator lead for pivoting all slats simultaneously.

24. A shutter for application beside a wall opening to block passage through the wall opening comprising:

a frame defining an open central space and having a closed interior cavity;

a plurality of crossbars extending across the space with their ends extending into the interior cavity; and a tie assembly within the interior cavity connected to the ends of the crossbars to prevent the crossbar ends from being pulled out of the frame.

25. The shutter of claim 24 wherein the frame comprises joined hollow tube sections, the closed interior cavity comprising the tube section hollows.

26. The shutter of claim 24 wherein the frame comprises a corner fitting and at least two tubular frame members, the tubular frame members being fastened to the corner fitting.

27. The shutter of claim 24 wherein the frame is made primarily of steel.

28. The shutter of claim 24 comprising hinges for pivotally connecting the frame to a wall portion adjacent the wall opening.

29. The shutter of claim 28 comprising a latch for holding the frame pivoted into a position beside the wall opening.

30. The shutter of claim 29 wherein the latch is substantially inside the interior cavity.

31. The shutter of claim 24 wherein the wall opening comprises a window which separates the interior and exterior of a building, and wherein the shutter is adapted to be mounted adjacent the interior side of the window.

32. The shutter of claim 24 wherein the frame comprises an inner wall, the wall having a plurality of holes through which the crossbar ends extend.

33. The shutter of claim 32 wherein the tie assembly extends along the side of the inner wall opposite the space defined by the frame.

34. The shutter of claim 33 wherein the tie assembly extends adjacent to the portion of the inner wall between the holes and substantially perpendicular to the crossbars to prevent the tie assembly from being pulled through the holes in the inner wall.

35. The shutter of claim 24 wherein the crossbars are substantially straight and parallel, there being a first set of crossbar ends and a second opposite set of crossbar ends, and wherein the tie assembly comprises a first tie rod connected to the first set of crossbar ends and a second tie rod connected to the second set of crossbar ends.

36. The shutter of claim 35 wherein the tie rods are substantially perpendicular to the crossbars.

37. The shutter of claim 24 wherein the frame is made primarily of steel.

38. The shutter of claim 24 wherein the crossbars are made primarily of steel.

39. The shutter of claim 24 wherein the tie assembly is made primarily of steel.

40. The shutter of claim 24 comprising a plurality of slats connected to the crossbars so that they may be pivoted to vary the degree to which the space is blocked.

41. The shutter of claim 40 wherein the slats comprise thermal insulation.

42. The shutter of claim 40 wherein the slats are connected by an operator lead for pivoting all slats simultaneously.

* * * * *

UNITED STATES PATENT AND TRADEMARK OFFICE

CERTIFICATE OF CORRECTION

PATENT NO. : 4,967,509

DATED : November 6, 1990

INVENTOR(S) : L.M. Storey; G.M. Storey

It is certified that error appears in the above-identified patent and that said Letters Patent is hereby corrected as shown below:

Column 2, line 42, after "operating" and before "lead" delete the comma.

Column 2, line 46, after "is" and before "a" delete the comma.

Column 3, line 21, after "2," and before "shutter" change "eaoh" to -- each --.

Column 3, line 21, after "hook" delete "1B whioh" and insert -- 18 which --.

Column 3, line 36, after "opening" change "!5" to -- 15 --.

Column 5, line 36, after "be" and before "and" change "latched" to -- unlatched --.

Column 5, line 41, change "in&:o" to -- into --.

Signed and Sealed this

Nineteenth Day of May, 1992

*Attest:*

DOUGLAS B. COMER

*Attesting Officer*

*Acting Commissioner of Patents and Trademarks*